US008943983B2

(12) United States Patent
Reed et al.

(10) Patent No.: US 8,943,983 B2
(45) Date of Patent: Feb. 3, 2015

(54) BLOCK PEDESTAL HAVING SLIDABLY SUPPORTED HORIZONTAL MEMBERS

(75) Inventors: Petra Reed, Redwood City, CA (US); James P. Reed, Redwood City, CA (US)

(73) Assignee: Pedestal Designs, Inc., Boise, ID (US)

( * ) Notice: Subject to any disclaimer, the term of this patent is extended or adjusted under 35 U.S.C. 154(b) by 100 days.

(21) Appl. No.: 13/385,637

(22) Filed: Feb. 27, 2012

(65) Prior Publication Data

US 2012/0160138 A1 Jun. 28, 2012

Related U.S. Application Data

(62) Division of application No. 11/732,215, filed on Apr. 2, 2007, now Pat. No. 8,127,696.

(60) Provisional application No. 60/789,548, filed on Apr. 4, 2006.

(51) Int. Cl.

| | |
|---|---|
| ***A47B 91/00*** | (2006.01) |
| ***A47B 13/02*** | (2006.01) |
| ***A47F 5/16*** | (2006.01) |
| ***A47G 19/00*** | (2006.01) |

(52) U.S. Cl.

CPC ..... *A47B 91/005* (2013.01); *A47B 13/02* (2013.01); *A47F 5/16* (2013.01); *A47G 19/00* (2013.01)

USPC ..... 108/158.12; 108/181

(58) Field of Classification Search

CPC ..... B65D 19/00; B65D 19/06; B65D 19/08; B65D 19/12; B65D 19/14; B65D 19/16; B65D 19/22; A63H 33/04; A63H 33/06; A63H 33/08; A47G 29/00; F16M 11/00

USPC ..... 108/29, 56.1, 56.3, 57.17, 57.18, 57.19, 108/57.21, 57.33, 181, 182, 158.12; 248/346.01, 346.02, 678; 446/115, 446/118, 125, 127

See application file for complete search history.

(56) References Cited

U.S. PATENT DOCUMENTS

| | | | | | |
|---|---|---|---|---|---|
| 198,050 | A | * | 12/1877 | Scott | 446/82 |
| 243,567 | A | | 6/1881 | Ireland | |
| 283,090 | A | * | 8/1883 | Farnum | 248/346.02 |
| 554,661 | A | | 2/1896 | Dolittle | |
| 1,213,690 | A | * | 1/1917 | Quinones | 434/96 |
| 1,298,762 | A | | 4/1919 | Milligan | |
| 1,437,867 | A | * | 12/1922 | Sixta | 446/127 |
| 1,443,420 | A | | 1/1923 | Lennox | |
| 2,023,300 | A | * | 12/1935 | Barnett | 446/86 |
| 2,119,821 | A | | 6/1938 | Manley | |
| D118,463 | S | | 1/1940 | West | |
| 2,204,319 | A | * | 6/1940 | Parsons et al. | 446/112 |
| 2,239,156 | A | * | 4/1941 | Lewis | 248/678 |
| 2,377,904 | A | * | 6/1945 | Roach | 269/40 |
| 2,692,107 | A | * | 10/1954 | De Ridder et al. | 108/57.17 |
| 2,696,356 | A | * | 12/1954 | Baumann | 108/51.3 |
| 2,883,764 | A | * | 4/1959 | Stephens | 446/118 |
| 3,131,656 | A | * | 5/1964 | Houle | 108/51.3 |

(Continued)

*Primary Examiner* — Michael Safavi

(74) *Attorney, Agent, or Firm* — Pedersen and Company, PLLC; Ken J. Pedersen; Barbara S. Pedersen

(57) ABSTRACT

A pedestal which comprises a horizontal component and one or more vertical components which fit into open channels or fit over straight projections in the upper surface of the horizontal component. The pedestals are particularly useful in the catering and hospitality industry for supporting food and beverage containers, tableware, flower vases and sculptures.

9 Claims, 1 Drawing Sheet

(56) References Cited

U.S. PATENT DOCUMENTS

| | | | | | |
|---|---|---|---|---|---|
| 3,161,986 | A | * | 12/1964 | Stubbmann et al. | 446/115 |
| 3,176,676 | A | | 4/1965 | Caldwell | |
| 3,538,862 | A | | 11/1970 | Patriarca | |
| D221,781 | S | | 9/1971 | Caigan | |
| 3,654,877 | A | * | 4/1972 | Barrett | 108/56.1 |
| 3,858,495 | A | | 1/1975 | Gotwalt | |
| 3,878,796 | A | * | 4/1975 | Morrison | 108/56.1 |
| 3,942,654 | A | * | 3/1976 | Warrick | 206/599 |
| 4,147,007 | A | * | 4/1979 | Eppich | 52/570 |
| 4,169,417 | A | * | 10/1979 | Gemvik | 108/56.3 |
| 4,220,099 | A | * | 9/1980 | Marchesano | 108/57.19 |
| 4,397,246 | A | * | 8/1983 | Ishida et al. | 108/55.3 |
| 4,424,753 | A | * | 1/1984 | Eatherton | 108/57.33 |
| D287,677 | S | | 1/1987 | Pomeroy et al. | |
| 4,760,802 | A | | 8/1988 | Leong | |
| 4,841,879 | A | * | 6/1989 | Ferguson | 108/57.19 |
| 4,841,880 | A | * | 6/1989 | Ferguson | 108/57.19 |
| 4,955,490 | A | | 9/1990 | Schäfer | |
| D321,101 | S | | 10/1991 | Zucker | |
| 5,101,737 | A | * | 4/1992 | Gomez | 108/57.18 |
| D328,536 | S | | 8/1992 | Ma | |
| 5,269,231 | A | | 12/1993 | Johnson | |
| 5,272,990 | A | * | 12/1993 | Carter | 108/51.3 |
| 5,353,716 | A | | 10/1994 | Wilbert | |
| 5,425,198 | A | | 6/1995 | Coy | |
| 5,425,314 | A | | 6/1995 | MacFarland | |
| 5,440,998 | A | * | 8/1995 | Morgan et al. | 108/57.18 |
| 5,487,345 | A | * | 1/1996 | Winebarger et al. | 108/51.3 |
| 5,537,937 | A | * | 7/1996 | Juvik-Woods | 108/51.3 |
| 5,662,048 | A | * | 9/1997 | Kralj et al. | 108/56.3 |
| 5,687,653 | A | * | 11/1997 | Bumgarner | 108/57.19 |
| 5,829,602 | A | | 11/1998 | St. John Danko | |
| 5,842,425 | A | | 12/1998 | van der Aa | |
| 5,887,513 | A | | 3/1999 | Fielding et al. | |
| 5,967,056 | A | * | 10/1999 | Plante | 108/56.1 |
| 5,971,830 | A | * | 10/1999 | Tobin | 446/256 |
| 5,996,819 | A | | 12/1999 | Klein | |
| 5,996,820 | A | | 12/1999 | Broadnax | |
| 6,039,192 | A | | 3/2000 | Hollander | |
| 6,041,719 | A | * | 3/2000 | Vidal et al. | 108/51.3 |
| 6,158,360 | A | | 12/2000 | Cheng | |
| 6,182,841 | B1 | | 2/2001 | Klein | |
| D446,043 | S | | 8/2001 | Stoppenhagen et al. | |
| 6,314,869 | B1 | | 11/2001 | Bourgeois | |
| D453,372 | S | | 2/2002 | Pecoskie | |
| 6,505,804 | B1 | | 1/2003 | Francis et al. | |
| 6,688,573 | B2 | | 2/2004 | Reed et al. | |
| 6,877,442 | B2 | | 4/2005 | Helle | |
| 6,915,994 | B2 | | 7/2005 | Oddsen | |
| 6,938,558 | B1 | * | 9/2005 | Peres | 108/56.3 |
| 7,407,144 | B2 | | 8/2008 | Reed et al. | |
| 7,490,561 | B1 | * | 2/2009 | Chou | 108/56.1 |
| 7,856,933 | B2 | * | 12/2010 | Miller et al. | 108/56.1 |
| 8,127,696 | B2 | * | 3/2012 | Reed et al. | 108/181 |
| 8,286,563 | B2 | * | 10/2012 | Low | 108/56.3 |
| 2004/0226490 | A1 | * | 11/2004 | Polumbaum | 108/56.1 |
| 2005/0081764 | A1 | * | 4/2005 | Michaels et al. | 108/56.3 |
| 2005/0166804 | A1 | * | 8/2005 | Hansen | 108/56.3 |
| 2008/0066657 | A1 | * | 3/2008 | Kuo | 108/57.19 |

* cited by examiner

FIG. 1
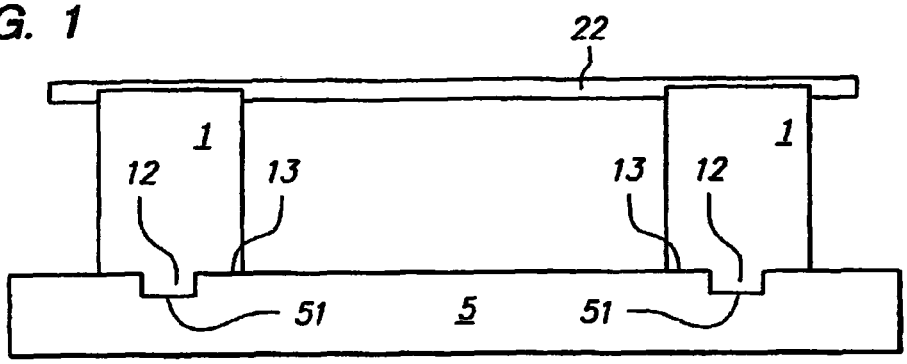
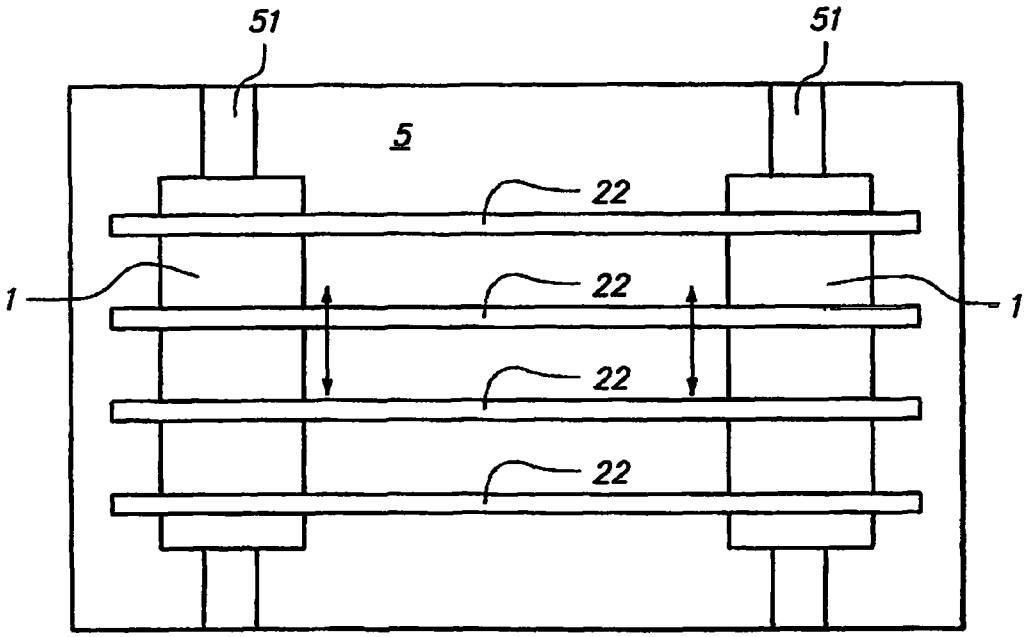
FIG. 2
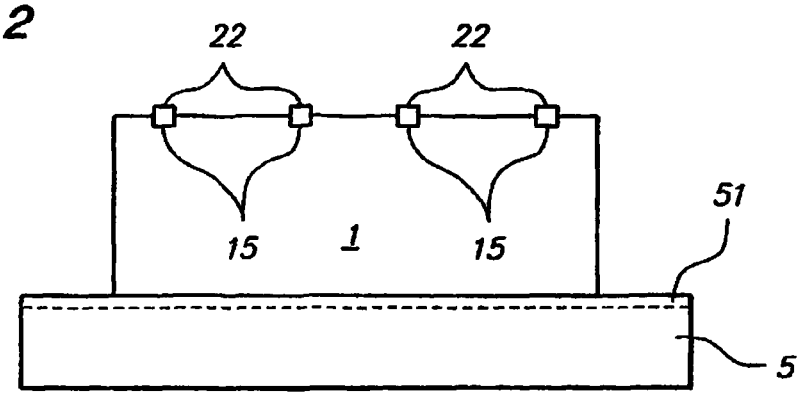
FIG. 3

BLOCK PEDESTAL HAVING SLIDABLY SUPPORTED HORIZONTAL MEMBERS

CROSS-REFERENCE TO RELATED APPLICATIONS

This application is a divisional of, and claims priority from, commonly assigned application Ser. No. 11/732,215, filed Apr. 2, 2007, now U.S. Pat. No. 8,127,696. Application Ser. No. 11/732,215 claims priority from Provisional Application No. 60/789,548, filed Apr. 4, 2006, and is related to (1) commonly assigned application Ser. No. 10/734,868, filed Dec. 12, 2005, now U.S. Pat. No. 7,407,144, (2) application Ser. No. 10/117,686, filed Apr. 5, 2003, now U.S. Pat. No. 6,688,573, and (3) application Ser. No. 09/905,702, filed Aug. 2, 2001, now abandoned. This application is also related to commonly assigned U.S. Pat. Nos. 6,688,573, 7,673,843 and 7,722,005. The disclosure of each of the above-identified applications and patents is incorporated herein by reference for all purposes.

BACKGROUND OF THE INVENTION

This invention relates to pedestals. The term "pedestal" is used herein to denote a structure which can be placed on a surface, often a horizontal surface, for example on the earth, on the floor of a building, or on an elevated surface (for example a buffet or other table, sideboard or desk) and which will support objects (e.g. tableware of all kinds, foodstuffs for consumption, and other objects being displayed for commercial and/or aesthetic purposes) placed on top of, or at intermediate levels of, the pedestal. For example, pedestals are used in the catering and hospitality industry to support serving dishes, containers, platters, trays, jugs, glasses, bottles, cutlery, ice sculptures and flower vases at positions chosen for functional and/or decorative reasons.

SUMMARY OF THE INVENTION

We have discovered, in accordance with the present invention, novel pedestals, and novel pedestal components which are useful for making the novel pedestals and for other purposes. The invention includes novel kits comprising components which can be assembled to make the novel pedestals; methods for making the novel pedestals; and methods of displaying objects on the novel pedestals.

In normal use, the pedestals of the invention comprise one or more generally vertical members and one or more generally horizontal members. The references herein to vertical, horizontal, top, bottom, upper and lower assume that the pedestal is being used normally. However, the invention includes the possibility that the pedestal is in a different orientation, and the terms vertical and horizontal are used to include variations from the strictly vertical and strictly horizontal directions which do not have any substantial effect on the function of the components in question.

In a first aspect, this invention provides a novel pedestal which comprises (1) a horizontal component which has
- (i) a substantially constant, generally rectangular core cross-section having a horizontal width w, and a height h, w being at least 10 times h,
- (ii) a horizontal dimension, l, measured at right angles to the width, which is at least 10 times h, and
- (iii) a horizontal upper surface which includes a plurality of configurations selected from straight open channels and straight projections; and (2) a vertical component (often referred to herein as a block component) which has
- (i) a substantially constant, generally rectangular core cross-section,
- (ii) a horizontal bottom surface comprising at least one configuration which is (a) a projecting section which fits slidably into a straight open channel in the upper surface of the horizontal component or (b) a recessed section which fits slidably over a straight projection on the upper surface of the horizontal component.

In a second aspect, this invention provides a novel horizontal component as defined in the first preferred aspect of the invention. These novel horizontal components are also useful for other purposes, for example to provide the base of a pedestal as disclosed in the applications and patents Incorporated herein by reference.

In a third aspect, this invention provides kits containing components for assembling one or more pedestals according to the first aspect of the invention, for example a kit comprising a horizontal component and a plurality of vertical components as defined in the first aspect of the invention.

In a fourth aspect, this invention provides a method of making a pedestal according to the first aspect of the invention, the method comprising placing, preferably manually placing, the pedestal components together, in a desired configuration. Preferably the components are secured to each other only by gravitational forces (including the weight of any objects placed on the pedestal).

In a fifth aspect, this invention provides a method of displaying objects which comprises placing, preferably manually placing, the objects on a pedestal according to the first aspect of the invention.

BRIEF DESCRIPTION OF THE DRAWINGS

The invention is illustrated by the accompanying drawings, which are diagrammatic and not to scale, and in which FIGS. 1-3 are side, plan and end views of pedestals according to the first aspect of the invention.

DETAILED DESCRIPTION OF THE INVENTION

In the Summary of the Invention above, and in the Detailed Description of the Invention, and in the accompanying drawings, reference is made to particular features (including method steps) of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

The term "comprises" and grammatical equivalents thereof are used herein to mean that other elements (i.e. components, ingredients, steps etc.) are optionally present. For example, a pedestal "comprising" (or "which comprises") components A, B and C can contain only components A, B and C, or can contain not only components A, B and C but also one or more other components. The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4. When, in this specification, a range is given as "(a first number) to (a second number)" or "(a first number)–(a second number)", this means a range whose lower limit is the first number and whose upper limit is the second number. For example, "from 8 to 20 inches" or "8-20 inches" means a range whose lower limit is 8 inches, and whose upper limit is 20 inches. The terms "plural" and "plurality" are used herein to denote two or more than two items.

Where reference is made herein to "first" and "second" elements, this is generally done for identification purposes; unless the context requires otherwise, the first and second elements can be the same or different, and reference to a first element does not mean that a second element is necessarily present (though it may be present). Where reference is made herein to "a" or "an" element, this includes the possibility that there are two or more such elements (except where the context excludes that possibility). Where reference is made herein to two or more elements, this includes the possibility that the two or more elements are replaced by a lesser number or greater number of elements providing the same function (except where the context excludes that possibility). The numbers given herein should be construed with the latitude appropriate to their context and expression; for example, each number is subject to variation which depends on the accuracy with which it can be measured by methods conventionally used by those skilled in the art.

Some of the components used in this invention are defined as having "a substantially constant generally rectangular core cross-section". Those components are also defined as having recessed and projecting sections and/or channels in their top and/or bottom surfaces. The term "core cross-section" is used herein to denote the largest-area cross-section which can be drawn by four straight lines within the actual cross-section of the component. The term "generally rectangular core cross-section" is used herein to denote any core cross-section which has a closed perimeter and which is rectangular or which provides the same functionality as a rectangular cross-section. Thus, the generally rectangular core cross-section can, for example, be a square; a rectangle whose height is substantially greater than, e.g. at least twice, its width; a rectangle whose height is substantially less than, e.g. less than 0.5 times, its width; a parallelogram; a trapezium; or a circle or an oval which has been modified so that the cross-section has flat top and bottom surfaces. The component can be solid, or it can contain one or more voids. The term "substantially constant" in the term "substantially constant generally rectangular core cross-section" means that the cross-section is constant, as is generally preferred, or varies (regularly or irregularly) in a way which provides the same functionality, and optionally the same appearance, as a constant cross section.

Vertical (or Block) Components

The vertical components used in this invention preferably have a bottom surface which comprises at least one recessed section and at least one projecting section, thus defining a projecting section which can fit slidably into a straight open channel in the upper surface of a horizontal component and/or a recessed section which can fit slidably over a straight projection on the upper surface of a horizontal component. The vertical components can optionally have a top surface which comprises a plurality of block channels. The pedestals of the invention can contain two or more vertical components which are fitted slidably to the same or different horizontal components.

In some embodiments, the pedestal includes first and second block components, which may be the same or different, and a plurality of horizontal support members, each support member being slidably fitted into a block channel in the first block component and a block channel in the second block component. The support members can for example be at an angle, preferably a right angle, to the lower support members. In some embodiments, at least some, preferably all, of the support members are as disclosed in U.S. Pat. No. 7,407,144.

Optional Features of the Bottom Surface of the Vertical (or Block) Component

The bottom surface of the vertical component can optionally have one or more of the following features.

(A1) It comprises a single elongate projecting section and two elongate recessed sections, one on each side of the projecting section.

(A2) It comprises a plurality of projecting sections, the number of projecting sections being n, and a plurality of recessed sections, the number of recessed sections being from n−1 to n+2, so that the component can be fitted, preferably slidably fitted, over a plurality of adjacent straight, parallel and equispaced support members, with at least some of the projecting sections extending downwards between a pair of adjacent support members and at least some of the recessed sections resting on a support member. In one embodiment, there are two projecting sections, and three recessed sections, and the projecting sections are positioned and shaped so that the block components can be placed in a number of different orientations over a plurality of parallel straight support members, for example so that the channels in the block component are at right angles to, or parallel to, or at an angle (e.g. about 45°) to, the support members. The projecting sections can for example have a round cross-section, or a regular polygonal, e.g. octagonal, cross-section.

(A3) It comprises two projecting sections and a single recessed section between the two projecting sections, so that the component can be slidably fitted over a single straight support member or over a plurality of straight and parallel support members, with the recessed section resting on the support member or support members, and the projecting sections extending downwards adjacent to the side of a support member.

(A4) The bottom surface of the component comprises a single projecting section and two elongate recessed sections, one on each side of the projecting section, the projecting section having a cross-section, e.g. a round cross-section, which enables it to rotate and to slide between a pair of adjacent straight and parallel support members, so that the component can be slidably and rotatably fitted over a pair of adjacent straight and parallel support members, with the projecting section between the support members and the recessed sections resting on the support members. The ability of the component to rotate can be through 360° or through some smaller angle, and the component can comprise stops or other means which enable a user to set the angle at a desired value and/or to recognize when the angle is at a desired value.

(A5) It is such that the component can be slidably fitted over a support member or a plurality of support members as disclosed in U.S. Pat. No. 7,407,144.

Optional Features of the Top Surface of the Vertical (or Block) Component

The top surface of the vertical component can be of any kind. It can for example be planar, e.g. so that it can support tableware, or it can have a non-planar configuration which fulfills a desired functional or decorative purpose. In some block components, the top surface comprises a plurality of block channels such that horizontal upper straight support members can be placed parallel to each other in the block channels. The block channels can for example have one or more of the following characteristics.

(B1) They are shaped and located so that it is possible to place a plurality of support members in the block channels so that the support members are at an angle, preferably at a right angle, to the lower support member or members over which the bottom surface of the component can be fitted; for example the block channels are at right angles to the projecting section or sections forming part of the bottom surface of the component.

(B2) The distance between the block channels is substantially the same as the width of the projecting section or sections on the bottom surface.

(B3) The height and/or width of the block channels in the top surface is substantially the same as the height and/or width of the recesses in the bottom surface.

(B4) At least some, preferably all, of the block channels are such that support members as disclosed in U.S. Pat. No. 7,407,000 144 can be slidably fitted therein.

(B5) There are 2 to 8, e.g. 3 to 6, for example 5, channels.

(B6) They are rectangular (including square) in cross-section.

(B7) The block channels are sized and positioned, and the bottom surface of the component is configured, so that, if two upper support members are placed in two adjacent block channels, an identical block component can be slidably fitted over two upper support members.

Other Optional Features of the Vertical (or Block) Component.

(C1) The component has block channels in its upper surface and has at least one of the following features (i) a core cross-section which is rectangular (including square), (ii) the ratio of the width to the height of the core cross section is from 0.5:1 to 1:40, e.g. 1:1 to 1:6, for example 1.5:2 to 1:4, (iii) the area of the core cross section is 2 to 16, for example 3 to 8, in.$^2$, and (iv) the component is 3 to 20 inches, e.g. 4 to 10 inches, long, and/or 1 to 6 inches, e.g. 1.5 to 3 inches wide, and/or 0.5 to 8 inches, e.g. 1 to 4 inches high.

(C2) The component does not have block channels in its upper surface, for example is planar, and has at least one of the following features (i) a core cross-section which is rectangular, (ii) the ratio of the width to the height of the core cross section is from 4:1 to 40:1, e.g. 10:1 to 30:1, for example 6:1 to 2:1, (iii) the area of the core cross section is 2 to 16, for example 3 to 8, in.$^2$, and (iv) the component is 3 to 20 inches, e.g. 4 to 10 inches, long, and/or 1 to 6 inches, e.g. 1.5 to 3 inches wide, and/or 0.5 to 8 inches, e.g. 1 to 4 inches high.

(C3) The sides of the component are free of channels.

(C4) The component comprises (i) a bottom portion which provides the bottom surface, and (ii) a top portion which provides the top surface and which is rotatably connected to the bottom portion, so that when the bottom portion is fitted over one or more support members, the top portion can be rotated relative to the bottom portion. The ability of the top and bottom portions to rotate can be through 360° or through some smaller angle, and the component can comprise stops or other means which enable a user to set the angle at a desired value and/or to recognize when the angle is at a desired value.

The Horizontal Component of the Invention

The bottom surface of the horizontal component can be planar, so that it can be placed on a flat horizontal surface, or can be configured so that it can be located on top of other components of a pedestal.

The horizontal components can optionally have one or more of the following characteristics.

(D1) Each of the length l and the width w is at least 20 times, e.g. at least 40 times, the thickness h.

(D2) It is sufficiently rigid to remain substantially planar when it is placed on an irregular generally horizontal surface.

(D3) The base channels have a depth substantially equal to the depth of a projecting section on the bottom surface of a block component, or a lesser depth, for example 0.04 to 0.25 inch, e.g. 0.04 to 0.125 inch In the third aspect of the invention, the components for a pedestal according to the first aspect of the invention can be packed into any suitable container, optionally having compartments for different components, for example a box or a bag, for example a cardboard box or fabric bag. The components can be selected so that they can be assembled into a wide variety of pedestals of different functionalities, shapes, dimensions and decorative appearances. The invention makes it possible for users to transport a kit of relatively small dimensions to, for example, a particular catering or display event, and to construct, on site, one or more pedestals adapted to the particular requirements of the event. The components are preferably such that, after the event, they can be easily disassembled, cleaned (for example in commercial washing facilities) and repacked as a compact kit for transport to storage or to another event.

Reference is now made to the Figures, in which the same reference numerals are used to denote the same or similar features. FIG. 1 is a side view of a first pedestal of the invention which comprises lower and upper horizontal components 5 and 22 and two vertical components 1. The lower horizontal component 5 has channels 51 in its upper surface, and each of the vertical components has a bottom surface having two recessed sections 13 and a projecting section 12 which fits slidably into one of the channels 51. The upper horizontal component 22 is a planar horizontal component having a bottom surface which is configured so that it is located on top of the vertical components. FIGS. 2 and 3 show top and end views of a second pedestal of the invention which has the same side view as the pedestal shown in FIG. 1. In FIGS. 2 and 3, the top surfaces of the vertical components 1 and 2 have channels 15 therein, and supporting members 22 are fitted slidably in the channels 15 and extend between the vertical components.

What is claimed is:

1. A pedestal which comprises:

(1) a horizontal component which has:

(i) a substantially constant generally rectangular core cross-section having a horizontal width w, and a height h, w being at least 10 times h, (ii) a horizontal dimension 1, measured at right angles to the width, which is at least 10 times h, and (iii) a horizontal upper surface which includes a plurality of elongated, horizontally-extending configurations selected from straight open channels and straight projections;

(2) first and second vertical components, each of which has:

(i) a substantially constant, generally rectangular core cross-section, (ii) a horizontal bottom surface comprising at least one configuration which is (a) a projecting section or (b) a recessed section, and (iii) a horizontal top surface comprising a plurality of horizontally-elongated straight open channels, wherein said projecting sections are received in, and horizontally slidable in, said straight open channels in the upper surface of the horizontal component, or said recessed sections receive, and are horizontally slidable over, said straight projections on the upper surface of the horizontal component, and (3) a plurality of parallel elongated support members extending between said first and second vertical components and slidably received in the horizontally-elongated straight open channels in the horizontal top surface of said first and second vertical components;

wherein the horizontal and vertical components and support members are secured to each other only by gravitational force.

2. A pedestal according to claim 1 wherein the horizontal component has a substantially planar bottom surface.

3. A pedestal according to claim 1 wherein each of the horizontal dimension 1 and the width w is at least 20 times the height h.

4. A pedestal according to claim 1 wherein said plurality of elongated, horizontally-extending configurations are straight open channels and the first and second vertical components each comprise a projecting section which fits slidably into the straight open channel, and each straight open channel has a depth substantially equal to or less than the depth of the projecting section.

5. A pedestal according to claim 1 wherein each of the first and second vertical components has a core cross-section which is rectangular and has a width parallel to the elongated, horizontally-extending configurations of the horizontal component, and a height parallel to the height h of the horizontal component, such that the ratio of the width to the height of the core cross section of each of said first and second vertical components is from 4:1 to 40:1.

6. A pedestal according to claim 1 wherein the horizontal dimension 1 and the width w of said horizontal component is at least 20 times the height h of said horizontal component.

7. A pedestal according to claim 6 wherein, each of the horizontal dimension and the width w of said horizontal component is at least 40 times the height h of said horizontal component.

8. A pedestal comprising:

a horizontal component having a horizontal upper surface comprising an outermost horizontal perimeter and a plurality of elongated, horizontally-extending configurations selected from straight open channels and straight projections;

first and second vertical components each having:

a horizontal bottom surface comprising at least one configuration that is (a) a projecting section or (b) a recessed section; and a horizontal top surface comprising a plurality of horizontally-elongated, straight open channels;

wherein (a) said projecting sections of the first and second vertical components are received in, and horizontally-slidable in, said straight open channels, or (b) said recessed sections of the first and second vertical components receive, and are horizontally-slidable over, said straight projections; and the pedestal further comprises a plurality of elongated support members, each support member extending between, and supported by, said first and second vertical components by being received in one of said open channels of the first vertical component and in one of said open channels of the second vertical component;

wherein the vertical components and the support members do not extend horizontally out beyond said outermost horizontal perimeter; and wherein the horizontal component, vertical components, and support members are secured to each other only by gravitational force.

9. A pedestal comprising:

a horizontal component having a horizontal upper surface comprising a plurality of elongated, horizontally-extending configurations selected from straight open channels and straight projections;

first and second vertical components, each having a substantially constant, generally rectangular core cross-section, a horizontal bottom surface comprising at least one configuration that is a projecting section or a recessed section, wherein said projecting sections are received in, and horizontally slidable in, said open channels, or said recessed sections receive, and are horizontally slidable over, said straight projections, and a horizontal top surface comprising a plurality of parallel, horizontally-elongated straight open channels;

a plurality of parallel, elongated support members, each support member having a first end and a second end, and each support member extending between said first and second vertical components and slidably received in the open channels of said first and second vertical components, wherein the first and second ends of each support member protrude horizontally out beyond said first and second vertical components, and wherein the horizontal and vertical components and support members are secured to each other only by gravitational force.

* * * * *